United States Patent [19]

Low

[11] 4,377,378

[45] Mar. 22, 1983

[54] LIGHTER MECHANISM

[76] Inventor: Peter G. S. Low, BM Magister, London WC1N 3XX, England

[21] Appl. No.: 163,993

[22] Filed: Jun. 30, 1980

[51] Int. Cl.[3] ..... F23Q 2/08

[52] U.S. Cl. ..... 431/140

[58] Field of Search ..... 431/138, 139, 140, 141, 431/142, 143

[56] References Cited

U.S. PATENT DOCUMENTS 3,251,202 5/1966 Racek ..... 431/143

*Primary Examiner*—Carroll B. Dority, Jr.

*Attorney, Agent, or Firm*—Toren, McGeady and Stanger

[57] ABSTRACT

A lighter has few moving parts. A lid assembly which closes a fuel supply and which rotates a flint wheel can be controlled by the same spring or other resilient means which bears a flint against the flint wheel. The lid assembly has one or more cams which bear against cam guides; the shape of these cams and guides are such that the spring produces a turning moment on the lid assembly which keeps the lid assembly closed when in the closed position and open when in the open position. A second spring can be provided, thereby increasing the turning moment on the lid assembly without increasing friction between the flint and the flint wheel. The cam guides can be formed as part of the body of the lighter, guides, or they can be provided in a separate structure housed within the lighter body, guides.

15 Claims, 12 Drawing Figures

LIGHTER MECHANISM

BACKGROUND TO THE INVENTION

The present invention relates to a lighter, such as a cigarette lighter. In particular, the invention relates to a single-action mechanism which may employ one compression spring both to bear a flint against a flint wheel and to control movement of a lid assembly. However, a second spring may be included to control more forcefully the lid assembly without causing additional pressure of the flint against the flint wheel.

In general, there are two principal mechanical features in a simple cigarette lighter. Firstly, a flint wheel must be provided which can be rotated to abrade a flint and the second feature is a lid or cover which not only protects any moving parts but also turns a fuel supply on and off as it is opened and closed. It is common practice for these two features to be provided by one rather complex mechanism. However, such single-action lighter mechanisms have a large number of moving parts. They are, therefore, complex and expensive to produce. Another disadvantage of these known mechanisms is that they are bulky and, therefore, take up a large amount of the total volume of the lighter, thereby reducing the space available for fuel.

BRIEF SUMMARY OF THE INVENTION

I have now devised a lighter having a simplified single-action lighter mechanism which has very few moving parts.

The present invention provides a lighter having a body which houses:

(a) a rotatable flint wheel;

(b) a resilient means which can bear against said flint wheel;

(c) a lid assembly for the fuel outlet of the lighter, having a cam and being mounted coaxially with said flint wheel and connected to said flint wheel via a ratchet mechanism such that opening movement of said lid assembly also rotates said flint wheel; and (d) a cam guide against which said cam abuts; said cam being shaped such that pivoting of said lid assembly from a closed position to an open position causes the axis of rotation of said flint wheel to be moved in opposition to the force exerted by said resilient means thus causing said lid assembly to be biased towards a closed position when in the closed position.

DETAILED DESCRIPTION OF THE INVENTION

I prefer that the cam or cams are so shaped that the lid assembly is also biased towards an open position when in said open position.

The flint wheel and lid assembly are preferably mounted in a wheel holder which includes a tube housing a flint and which is biased so that the or each cam bears against the or each cam guide. This biasing force may be provided by a single compression spring within this tube; in this case the spring serves both to force the flint against the flint wheel, and, by transmission of force through the flint, to force cam against guide. If desired, an additional spring may be used to increase the turning moment on the lid assembly without the increase in flint to flint wheel friction that would result from use of a single powerful flint spring; this second spring is arranged to bear against the base of the tube and directly force the cam against its guide, thereby by-passing the flint and flint wheel.

The cam guide or guides may be fused to or integral with the body of the lighter, in wich case they are preferably protrusions, such as ridges positioned inwardly facing on the walls of the lighter at the top of the lighter. The lid assembly would then be positioned between these walls with its cams underneath and bearing against the cam guides. Alternatively, the guides may be provided on a separate structure positioned within the top of the lighter, and this has the advantage that assembly and dismantling can be easier and that the exterior of the lighter can be neater. This separate structure may include a tube within which the tube of the wheel holder lies; in this case the structure can be held in position by means of the flint screw, as is illustrated in the drawings.

The lighter of the present invention is operated by opening the lid assembly and this causes the flint wheel to turn and abrade the flint. A ratchet mechanism is preferably employed so that when the lid assembly is allowed to close the flint wheel remains stationary. Conveniently, the ratchet mechanism engages with teeth on the side of the flint wheel, but any suitable type of ratchet mechanism can be used. The lid assembly incorporates a device which shuts off the fuel supply when in the closed position. In the case of a petrol or other liquid fuel lighter this device may simply be a wick cover which forms a seal over the wick nozzle, and in the case of a gas lighter the device preferably operates a pressure valve.

A force from the spring or other resilient means (or one of the springs when two are used) is transferred through a flint, flint wheel axle, and then to one or more cams each of which bears against a cam guide. (Where two springs are used the force from the second acts directly through the tube of the wheel holder.) I prefer that there are two cams, one on each side of the flint wheel. In this case, there will be one cam guide on each inner side of the walls of the lighter body or of the separate structure. These guides may simply be inward-facing protrusions in the walls, for example small pegs, or they may be more substantial and extend along the top of the lighter walls; the important thing is that they provide a bearing point which causes a turning moment in the cams. When the lid assembly is opened the pivoting motion may be hindered by friction between the surfaces of the cams and the cam guides. This friction may be reduced by using small rollers as cam guides or providing small rollers in the periphery of the cams. It can be seen therefore, that the pressure exerted by the flint spring and by the second spring, if fitted, influences movement of the lid assembly.

In a preferred embodiment of the invention where the cam is so shaped that an open position of the lid assembly is also stabilized, this arrangement of springs and cam also assists flint wheel rotation. This is achieved because, after partial opening of the lid assembly, pressure of the cam against the cam guide tends to cause further rotation of the cam and the flint wheel. The stabilized open position of the lid assembly is not an essential feature of the invention, but it will be particularly useful for pipe-smokers.

The shape of the cams is not particularly critical and a rectangular shape with slight rounding at the corners is suitable. A more elaborate shape can, however, provide a larger surface area for contact with the side walls of an upper compartment of the lighter. The purpose of this is to reduce to a minimum side-to-side movement of the lid and to cover holes which may be provided in the body for insertion of a flint wheel axle during assembly; where a separate structure provides the cam guides such holes will be present in the structure and none are needed in the body since the structure can be withdrawn from the body for assembly of the flint wheel and axle.

BRIEF DESCRIPTION OF THE DRAWINGS

The invention is illustrated in more detail by the accompanying drawings, in which.

DETAILED DESCRIPTION OF THE DRAWINGS

Figure 1:
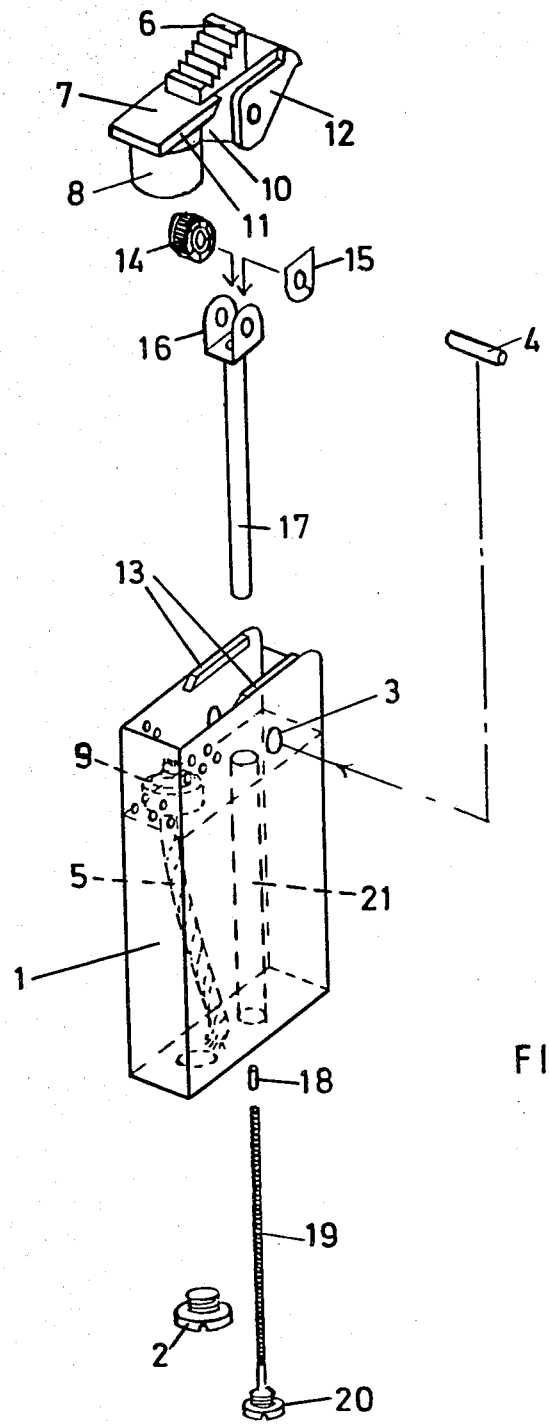
FIG. 1 is an exploded view of a lighter having a lighter mechanism employing a single spring.

FIG. 1 shows a petrol lighter although a gas lighter employing the novel ignition mechanism could equally well be made. The main body (1) of the lighter is divided into a lower fuel reservoir and an upper compartment which houses the ignition mechanism. The fuel reservoir is filled through a hole in the base of the main body and is plugged by a filler screw (2) with fitted washer. An alternative fuel seal is a sleeve closed at one end which can slide over the entire lower part of the lighter. A hole (3) is provided in each side of the upper compartment for insertion and removal of an axle (4). The walls of the upper compartment near wick (5) may be suitably perforated to allow the entry of air to support burning. A serrated protrusion (6) may be fused to the top of a lid assembly (7) to provide a grip for the thumb to operate the lighter. When the lid assembly (7) is closed, a rim of a cylindrical wick cover (8) rests on a wick nozzle (9), thereby preventing loss of fuel by evaporation from the wick. The lower part of the wick cover may be preferably detachable; this can aid dismantling and assembly of the ignition mechanism. The lid assembly has two flanges (10) on its lower surface which extend forward and are fused to the wick cover (11). A cam (12) is fused to the outer surface of the rear of each flange. The cams bear against the lower surfaces of cam guides (13) which protrude inwardly from the top of the walls of the upper compartment. In this particular embodiment, the cam guides extend approximately half way along the walls of the upper compartment. A flint wheel (14) and a ratchet (15) are housed in a wheel support (16) which consists of a pair of trunnion plates. The uppermost edge of the ratchet is straight and it lies flush against the underside of the lid assembly. Axle (4) passes freely into holes in the cams, wheel support, flint wheel and ratchet. These components therefore pivot about a common axis. The wheel support is fused to the uppermost end of a tube (17), which is preferably thin-walled and is conveniently made from steel, and which houses a flint (18) and a flint spring (19). The flint spring bears the flint against the flint wheel and it is secured at its lower end by a spring screw (20) which screws into the base of the lighter body. Tube (17) fits closely but slides freely within a tube housing (21) which extends from the base of the lighter through a fuel reservoir. It can be clearly seen from FIG. 1 that this lighter mechanism has very few moving parts: in this embodiment the principal parts are the lid assembly with its cams, the wheel support plus tube, flint wheel, ratchet and axle, and the flint and flint spring. There are two other features which are clearly apparent from FIG. 1. Firstly the lighter is simple, compact, and symmetrical when the lid assembly is closed, the working parts are protected and there are no sizeable apertures through which particles might enter and jam the mechanism. Secondly, the lighter has plenty of room for fuel; the ratio between the volume of the fuel reservoir and the overall volume for a lighter under three inches in length is about 0.75 compared with values of from 0.36 to 0.73 for conventional lighters.

Figure 2B:
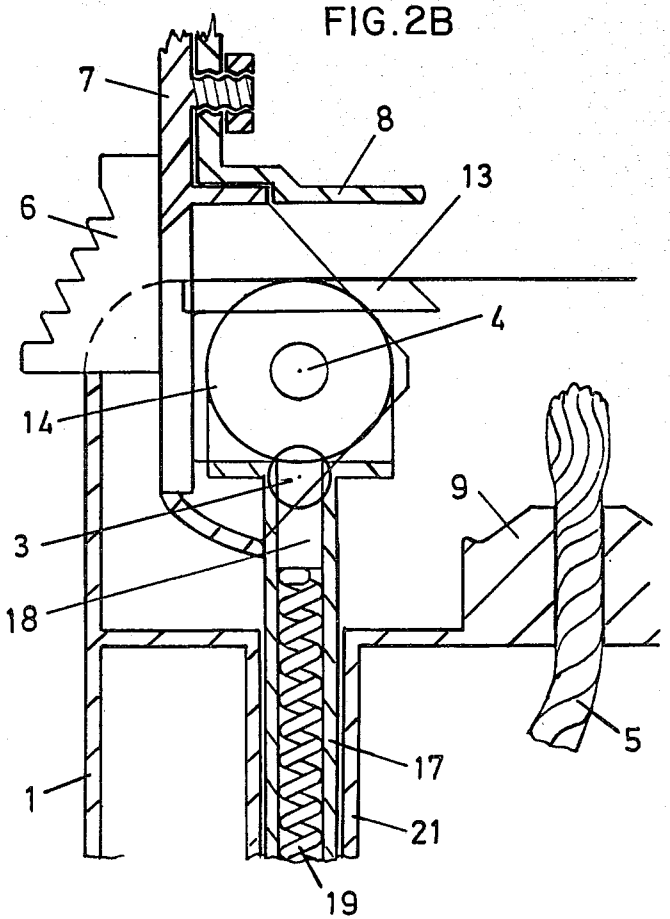
FIG. 2B is a side elevation similar to FIG. 2A, however, the lid is in the open position.
Figure 2A:
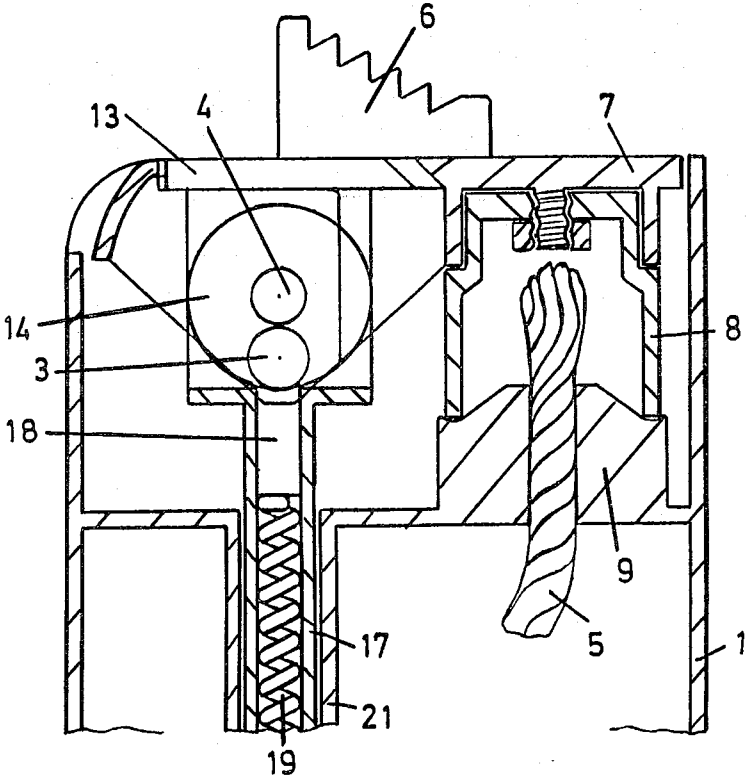
FIG. 2A is a side elevation of an ignition mechanism employing a single spring with the lid in the closed position.

Assembling and dismantling a lighter mechanism as illustrated in FIGS. 2A and 2B is very simple. The first step in dismantling the mechanism is to move lid (7) to the open position shown in FIG. 2B. The spring screw (20), flint spring (19) and flint (18) are then removed. Removal of the spring screw allows tube (17) to be lowered sufficiently for axle (4) to be in line with holes (3). When the spring screw is in place it prevents tube (17) from being lowered as far as this whilst allowing sufficient movement of tube (17) for the lid assembly to be opened. When axle (4) is aligned with holes (3) it is withdrawn. The lid assembly is then opened as far as it will go and the wheel and ratchet are removed. The wheel support and tube are then withdrawn from the tube housing. Finally, the lid assembly is moved forward of the cam guides and removed. These steps are simply reversed to put the lighter back together again.

Figure 3A:
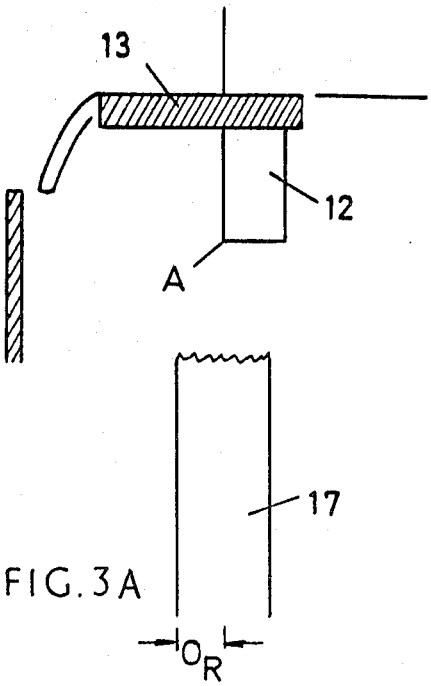
FIGS. 3A, 3B and 3C are schematic illustrations displaying the geometry of the ignition mechanism.
Figure 3B:
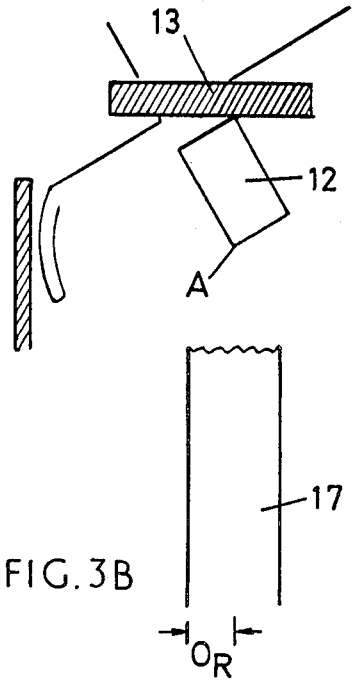
Figure 3C:
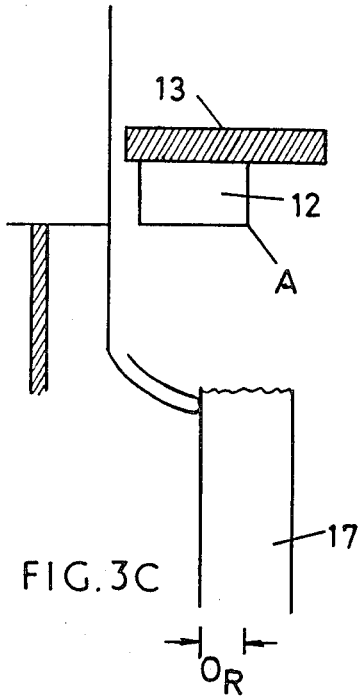

FIGS. 3A, 3B and 3C show schematically the geometry of the ignition mechanism according to the invention without any illustration of the specific configuration of the cams (12) shown in FIG. 1. FIG. 3A shows the position of the cams when the lid assembly is closed. In this Figure the spring exerts a force vertically through the centre of the flint wheel axle (point A) and this forces the horizontal surfaces of the cams against the cam guides. The position shown in the Figure is a stable position; this stable position is a few degrees further clockwise than the usual closed position in the assembled lighter. FIG. 3B shows the position of the cams when the lid is partially open. Here, a diagonal from point A to the peak of the cam is colinear with the force exerted by the spring—this position is therefore a position of temporary stability. FIG. 3C shows the fully open position. From these three Figures it can be seen that in opening the lid assembly the flint wheel and its associated components move downwards until the peak of the cam is at top dead centre. After this position, they rise to the position shown in FIG. 3C. The sequence is, of course, reversed when the lid is closed. When the lid is open its rear edge conveniently abuts against the tube (17) in which case this edge will lie away from the perpendicular through point A by a distance equal to the outside radius of tube (17). This distance is marked $O_R$ in the schematic diagrams of FIGS. 3A, 3B and 3C. Also, the rear wall of the main body (1) conveniently projects above a horizontal through A when the lid is closed by the same distance $O_R$. When the lid is open the rear of protrusion (6) will be on a line through A and will abut against the top edge of the rear wall. Therefore, if the lid is open to a full 90° it must rise by this distance $O_R$. This requirement for vertical movement of the wheel assembly is met by a cam designed as shown in these three Figures. The two contact surfaces are at different distances from the axle and the difference between these distances is $O_R$. A cam of this design also assists wheel rotation since the critical point shown in the FIG. 3B is reached well before the lid is half open. As an example, the long and short contact surfaces of the cams may be 7/32" and ⅛" respectively measured from A. In this case the critical position would be reached when the lid has rotated through an angle of approximately 30° from the horizontal (30° is approximately $\tan^{-1}4/7$).

Figure 4B:
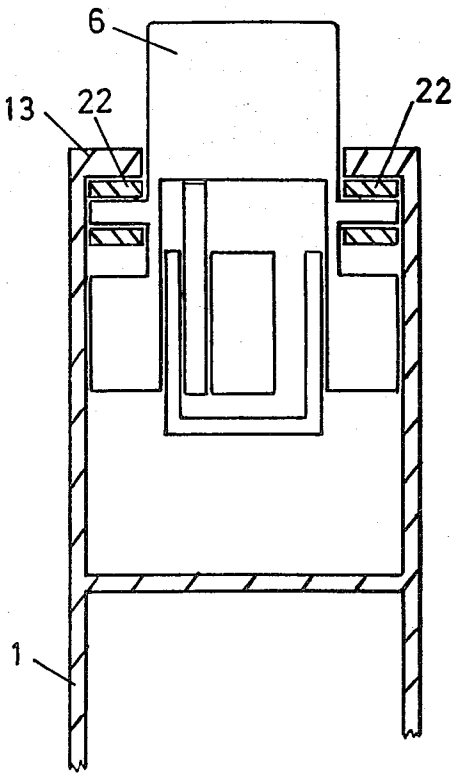
FIG. 4B is a partial sectional end view of the cam arrangement illustrated in FIG. 4A.
Figure 4A:
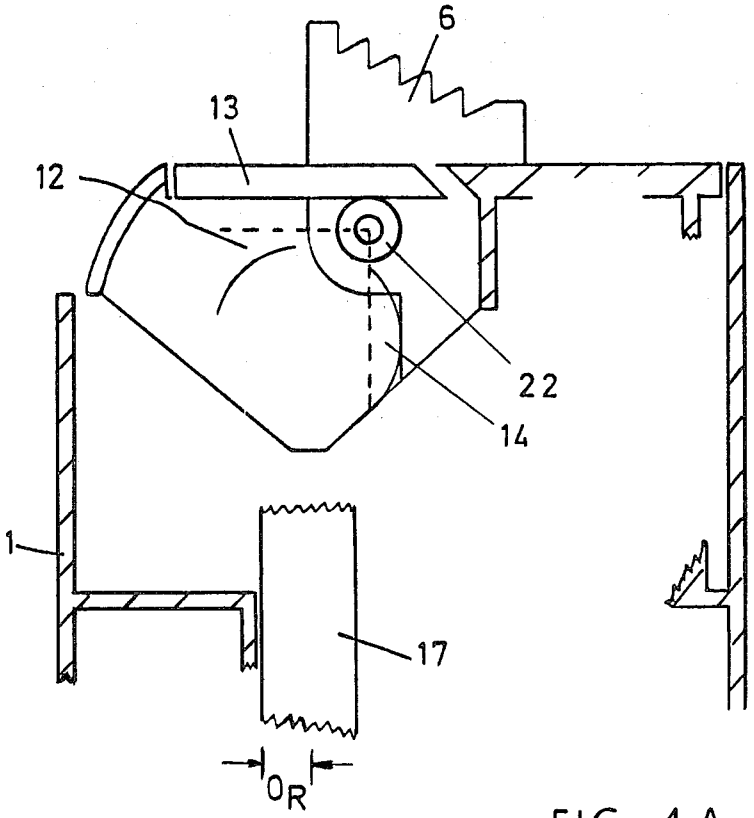
FIG. 4A is a partial sectional side view showing a cam arrangement where a roller is provided on the cam to eliminate sliding friction between the cam and a cam guide.

FIGS. 4A and 4B show a modified cam incorporating a rotary bearing which acts on the working surfaces of the cam guides. The peak of each cam (which is at the junction of the two working surfaces) is cut away to accommodate a small idler wheel (22) which is conveniently about ⅛" diameter and ⅛" thickness. The idler wheel revolves on a stud which is fused to the flange of the lid assembly; the wheel and stud are preferably both made of a hard-wearing metal or alloy. Since the reaction force exerted by the cam guide on the idler wheel passes through the stud, the stud must be positioned at the peak of the cam if the mechanical effect on the lid assembly is to remain unaltered. This distance from each working surface of the cam to the axle is therefore increased by an amount equal to the radius of the idler wheel. As a result, lines extended from the new working surfaces are tangential to the idler wheel periphery. The difference between the two new distances thus remains unaltered. The resulting larger cam (generally about 1/16" higher and about 1/16" longer) necessitates enlarging the ignition mechanism compartment. The cams should also be slightly thicker since an idler wheel less than ⅛", especially one less than 3/32", in thickness would wear excessively and would not therefore function reliably. In general, this modification would be expected to lead to an increase in the overall dimensions of the lighter from, say 1⁵/16" to 1³/8" from front to rear and from ½" to 9/16", and possibly to 11/16", in thickness. This modification makes the lighter mechanism much smoother in operation since sliding friction has, to a large extent, been eliminated.

Figure 5:
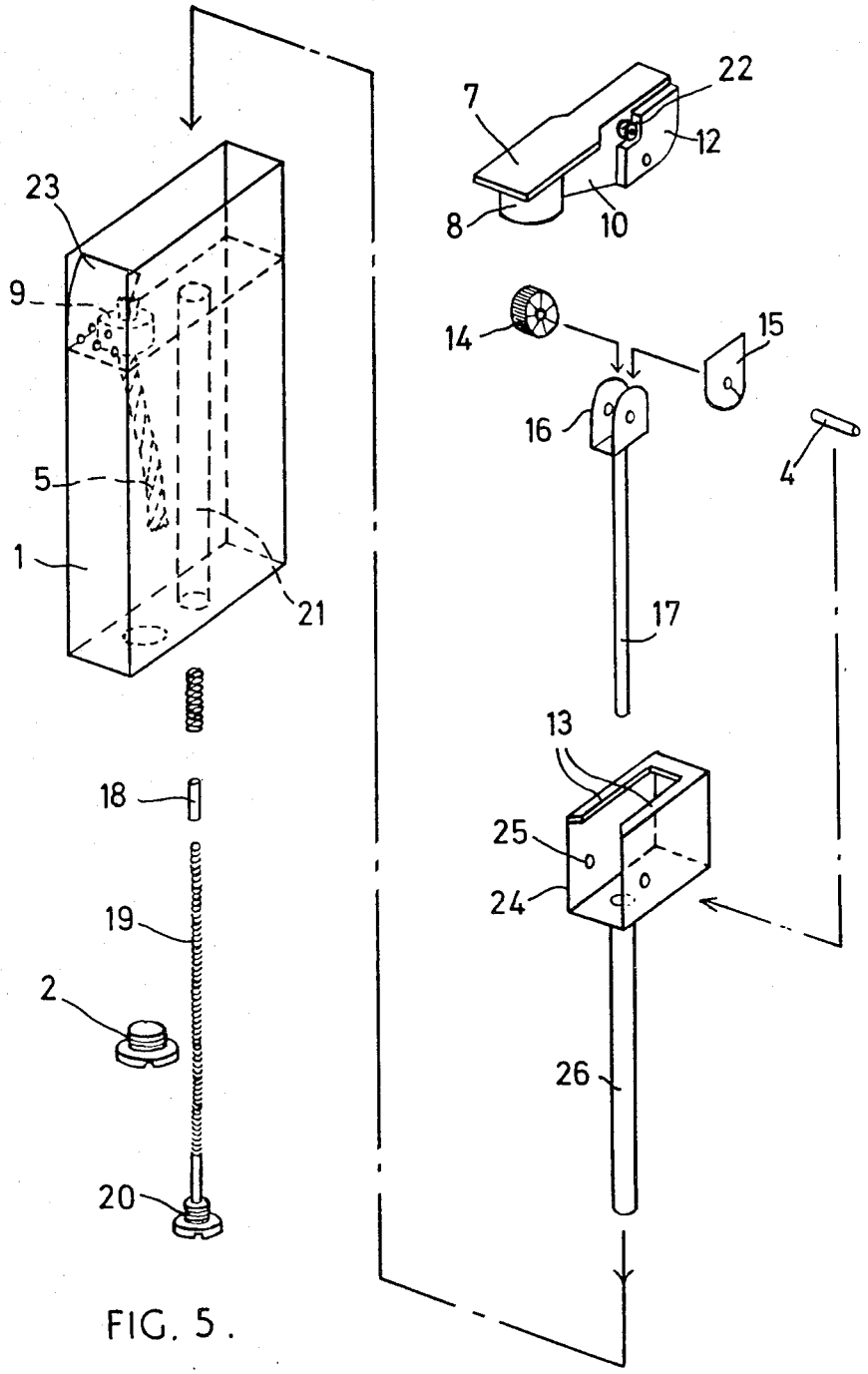
FIG. 5 is an exploded view of a lighter having a lighter mechanism employing two springs and cam guides provided on a separate structure.
Figure 6B:
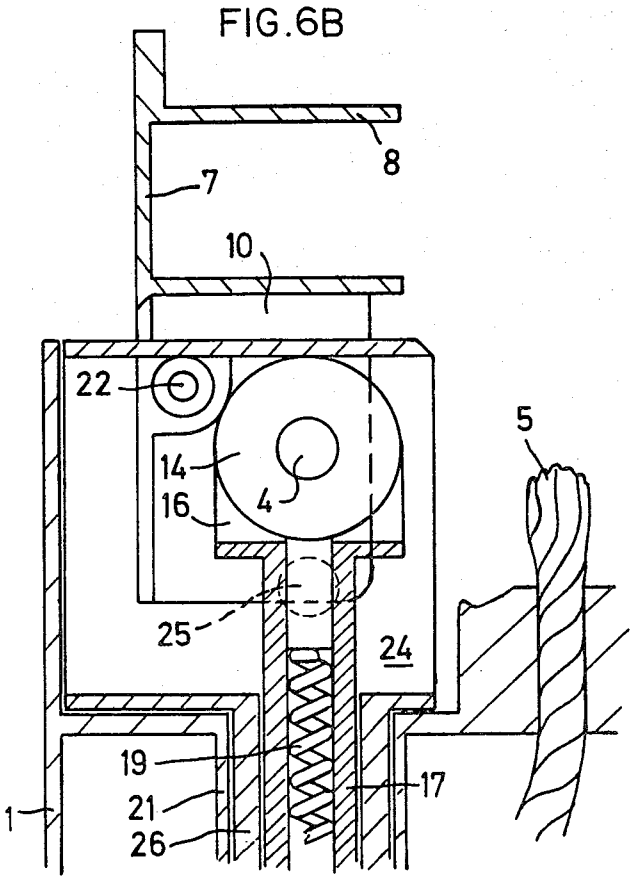
FIG. 6B is a partial side elevation, in section, similar to FIG. 6A, however, with the lid in the open position.
Figure 6A:
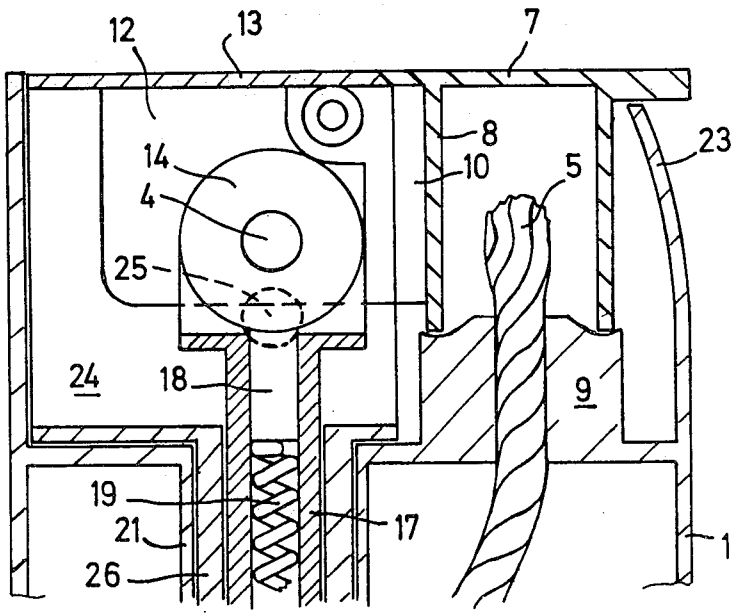
FIG. 6A is a partial side elevation, in section, of an ignition mechanism employing the separate structure for the cam guides with the lid in the closed position.
Figure 7:
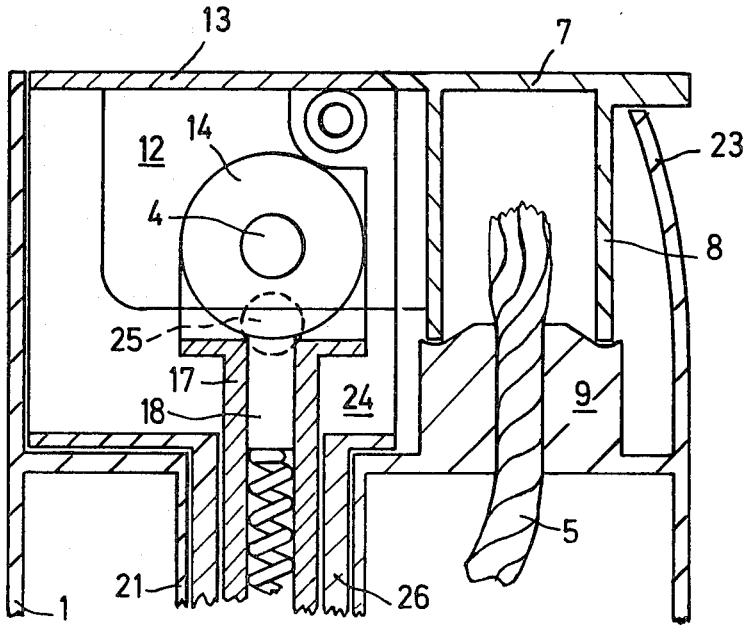
FIG. 7 is a side elevation of an ignition mechanism showing an arrangement for securing the separate structure to the lighter body.
Figure 7:
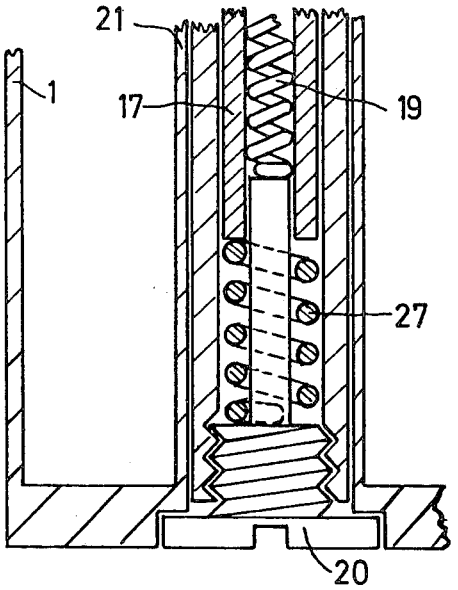

FIGS. 5, 6A and 6B shows a lighter employing a second spring to produce additional turning moment on the lid assembly and a separate structure providing the cam guides. These two features need not be combined, but I prefer that they are. In these figures, the main body of the lighter (1) is divided into a lower fuel reservoir, and an upper compartment which houses the ignition mechanism. The fuel reservoir is filled through a hole in the base stopped by the filler screw (2) with fitted washer. The walls of the upper compartment near the wick (5) may be suitably perforated to allow the entry of air to support burning.

The lid (7) when closed is flush with the top of the ignition mechanism compartment. The front wall (23) of the compartment may be recessed to allow the lid to be pushed up to operate the lighter. When the lid is closed, the rim of the cylindrical wick cover (8) rests on the wick nozzle (9), thereby preventing loss of fuel by evaporation from the wick. In the case of a gas lighter, the lid will operate a valve.

The lid has two perpendicular flanges (10) underneath, running forward to fuse with the wick cover. On the exterior and to the rear of each flange is a cam (12), the top front corner of which may be cut away to accommodate a small idler wheel (22), which acts as a roller bearing. The cam may be integral with or joined to the flange. The latter pivots on a small stud, and is positioned so that extensions of the cam working surfaces are tangential to the periphery of the roller. The roller bearings act against the lower surfaces of the cam guides (13).

The cam guides protrude horizontally inwards from the top of a structure (24), which may be U-shaped. This structure fits fairly tightly within the walls of the upper compartment; and the upper surfaces of the cam guides are then flush with the top of the upper compartment walls. The side walls of the structure (24) each have a hole (25) through which the axle (4) can be inserted or removed. From the bottom of the structure (24) a tube (26) extends vertically downwards, fitting closely inside a tube housing (21) which runs through the fuel reservoir. The bottom of this tube is threaded on the inside to accommodate the spring screw (20). When the latter is tightened, the structure (24) is pulled downwards and thus seated firmly on the base of the upper compartment.

The wheel holder (16) is in the form of a pair of trunnion-plates within which are mounted the wheel (14), and ratchet (15). The top of the ratchet is a straight edge which lies flush against the underside of the lid. The axle passes freely into the holes in the lid walls, wheel support, wheel, and ratchet. These components thus function about a common axis.

The wheel support is fused to or integral with the top of a flint-tube (17), within which are a flint (18), and flint spring (19). Pressure from the latter forces the flint upwards against the wheel, and is maintained by the spring screw. The flint-tube preferably fits closely but slides freely within the tube (26). The bottom of the flint-tube rests on a spring (27); the lower end of this spring (27) rests on the shoulders of the spring screw. The large spring (27) and the flint spring thus act together to maintain upward pressure of the roller bearings against the cam guides. The spring (27) is preferably short and is preferably a stronger spring than the flint spring.

As mentioned above, the cams and guides can be designed so that the lighter is operated merely by pushing up the lid at the front end. To facilitate this, the front wall of the ignition mechanism compartment can slope inwards at the top. By pushing up the lid, static friction between the wheel and flint is overcome, and the lid raised to an angle of approximately 40° from the horizontal. At this stage the roller bearings are behind the perpendicular through the axle, and the pressure from the flint spring and larger spring creates a turning moment to continue the rotation until the lid is fully open at, say, 90°. At this point the lid is stable in the open position due to spring pressure and cam shape. During closing of the lid, the wheel remains stationary due to the ratchet action.

The function of the spring (27) is to augment the flint spring action in providing a turning moment for lid opening and wheel rotation. The moment provided by the flint spring is dependent on flint friction and mechanism geometry only. Greater flint spring strength would therefore increase friction and wear on the flint and working parts, without increasing the turning moment. The spring (27) acts on the base of the flint tube, thereby increasing roller bearing pressure on the cam guide surfaces without increasing friction at the flint/-wheel interface. The total turning moment is thus increased.

The lighter illustrated in FIGS. 5, 6A, 6B and 7 may be dismantled as follows:

(1) Move lid to open position.
(2) Unscrew spring screw. Screw back in one turn. Press inwards to unseat U-section.
(3) Remove spring screw and withdraw flint spring, large spring, and flint, through bottom aperture.
(4) Lift out U-section and lid assembly.
(5) Close lid and depress until axle can be withdrawn through one of the holes in sides of U-section.
(6) Move lid forwards to withdraw.
(7) Remove wheel and ratchet.
(8) Lift out wheel support and flint-tube.

It can be reassembled simply by reversing this sequence of operations.

Advantages of the design

To summarise, this design can have the following advantages:

(1) Single action, simple operation.
(2) Few moving parts.
(3) Compactness and no sizeable apertures, when closed, through which particles might enter.
(4) Large fraction of total volume for fuel storage.
(5) Symmetry.
(6) The whole ignition mechanism can be removed and dismantled by removing the flint screw in the base of the lighter.
(7) Components can thus be easily cleaned or replaced if worn or damaged.

I claim:

1. A lighter having a body which houses:
(a) a rotatable flint wheel;
(b) a resilient means which can bear against said flint wheel;
(c) a lid assembly for the fuel outlet of the lighter, having a cam and being mounted coaxially with said flint wheel and connected to said flint wheel via a ratchet mechanism such that opening movement of said lid assembly also rotates said flint wheel; and
(d) a cam guide against which said cam abuts; said cam being shaped such that pivoting of said lid assembly from a closed position to an open position causes the axis of rotation of said flint wheel to be moved in opposition to the force exerted by said resilient means thus causing said lid assembly to be biased towards a closed position when in the closed position.

2. A lighter according to claim 1, in which said cam is so shaped that said lid assembly is biased towards an open position when in the open position.

3. A lighter according to claim 2, in which said cam is so shaped that said lid assembly automatically fully opens on being rotated a small amount from the closed position.

4. A lighter according to claim 1, in which said cam comprises a roller which bears against said cam guide.

5. A lighter according to claim 1, in which said resilient means is a compression spring.

6. A lighter according to claim 5, in which said flint wheel and lid assembly are mounted in a movable wheel holder; said wheel holder has a tube which can house a flint and said compression spring; said wheel holder is biased via said flint and said flint wheel by said compression spring so that said cam bears against said cam guide.

7. A lighter according to claim 1, which additionally has a second resilient means for bearing said cam against said cam guide.

8. A lighter according to claim 7, in which said second resilient means is a stronger than the resilient means which bears the flint against the flint wheel.

9. A lighter according to claim 7, in which the second resilient means is a compression spring.

10. A lighter according to claim 6 and to any one of claims 7, 8 and 9, in which said second resilient means bears against the end of said tube of said wheel holder distal from said lid assembly.

11. A lighter according to claim 1, in which said cam guide is integral with or fused to said body.

12. A lighter according to claim 1, in which said cam guide is provided on a separate structure housed within said body.

13. A lighter according to claim 12, in which said separate structure houses said lid assembly and a holder for said flint wheel.

14. A lighter according to claim 13, in which a movable wheel holder mounts said flint wheel and lid assembly, said wheel holder includes a tube, and said separate structure has a tube which houses the tube of said wheel holder.

15. A ligher according to claim 14, in which said separate structure is secured within said body by means of a flint spring screw which mates with the end of said tube of said separate structure distal from said cam guide.

* * * * *